US007730937B2

(12) United States Patent
Head

(10) Patent No.: US 7,730,937 B2
(45) Date of Patent: Jun. 8, 2010

(54) ELECTRIC SUBMERSIBLE PUMP AND MOTOR ASSEMBLY

(75) Inventor: Philip Head, West Drayton (GB)

(73) Assignee: Artificial Lift Company Limited, Great Yarmouth (GB)

( * ) Notice: Subject to any disclaimer, the term of this patent is extended or adjusted under 35 U.S.C. 154(b) by 0 days.

(21) Appl. No.: 12/009,608

(22) Filed: Jan. 18, 2008

(65) Prior Publication Data

US 2008/0196880 A1 Aug. 21, 2008

(30) Foreign Application Priority Data

Jan. 19, 2007 (GB) ..... 0701061.4

(51) Int. Cl.
*E21B 4/04* (2006.01)
*E21B 43/00* (2006.01)
*E21B 47/00* (2006.01)

(52) U.S. Cl. ..... 166/66.4; 166/66; 166/105; 166/254.2

(58) Field of Classification Search ..... 166/66, 166/66.4, 105, 254.2
See application file for complete search history.

(56) References Cited

U.S. PATENT DOCUMENTS 6,120,261 A * 9/2000 Al-Towailib ..... 417/356
6,510,899 B1 * 1/2003 Sheiretov et al. ..... 166/381
7,299,873 B2 * 11/2007 Hartman et al. ..... 166/302

* cited by examiner

*Primary Examiner*—William P Neuder
*Assistant Examiner*—Yong-Suk Ro
(74) *Attorney, Agent, or Firm*—Andrew Wilford

(57) ABSTRACT

An assembly for downhole applications comprises has an electric motor, a pump driven by the electric motor and having a lower pump inlet and an upper pump outlet, and a deployment tube from which the assembly is suspended from and by means of which the assembly can be lowered through the well. A nonrotating hollow shaft forms a bore extending from the tube through the motor and the pump to an assembly opening at the bottom of the assembly such that a device suspended on a wireline or coiled tube may be lowered through the deployment tube and pass through the electric motor and pump to a part of the well below the pump inlet. The motor is linked outside the bore to the pump for driving the pump.

8 Claims, 4 Drawing Sheets

ELECTRIC SUBMERSIBLE PUMP AND MOTOR ASSEMBLY

FIELD OF THE INVENTION

This invention relates to electric submersible pump and motor assembly that can be deployed down a well.

BACKGROUND OF THE INVENTION

Electrical submersible pumps are commonly used in oil and gas wells for producing large volumes of well fluid. An electrical submersible pump (hereinafter referred to "ESP") normally has a centrifugal pump with a large number of stages of impellers and diffusers. The pump is driven by a downhole motor, which is a large three-phase motor. A seal section separates the motor from the pump to equalize the internal pressure of lubricant within the motor to the pressure of the well bore. Often, additional components will be included, such as a gas separator, a sand separator and a pressure and temperature measuring module.

An ESP is normally installed by securing it to a string of production tubing and lowering the ESP assembly into the well. Production tubing is made up of sections of pipe, each being about 30 feet in length. The well will be 'dead', that is not be capable of flowing under its own pressure, while the pump and tubing are lowered into the well. To prevent the possibility of a blowout, a kill fluid may be loaded in the well, the kill fluid having a weight that provides a hydrostatic pressure significantly greater than that of the formation pressure. During operation, the pump draws from well fluid in the casing and discharges it up through the production tubing. While kill fluid provides safety, it can damage the formation by encroaching into the formation. Sometimes it is difficult to achieve desired flow from the earth formation after kill fluid has been employed. The kill fluid adds expense to a workover and must be disposed of afterward. EPS's have to be retrieved periodically, generally around every 18 months, to repair or replace the components of the ESP. It would be advantageous to avoid using a kill fluid. However, in wells that are 'live', that is, wells that contain enough pressure to flow or potentially have pressure at the surface, there is no satisfactory way to retrieve an ESP and reinstall an ESP on conventional production tubing.

Coiled tubing has been used for a number of years for deploying various tools in wells, including wells that are live. A pressure controller, often referred to as a stripper and blowout preventer, is mounted at the upper end of the well to seal around the coiled tubing while the coiled tubing is moving into or out of the well. The coiled tubing comprises steel tubing that wraps around a large reel. An injector grips the coiled tubing and forces it from the reel into the well. The preferred type of coiled tubing for an ESP has a power cable inserted through the bore of the coiled tubing. Various systems are employed to support the power cable to the coiled tubing to avoid the power cable parting from the coiled tubing under its own weight. Some systems utilize anchors that engage the coiled tubing and are spaced along the length of the coiled tubing. Another uses a liquid to provide buoyancy to the cable within the coiled tubing. In the coiled tubing deployed systems, the pump discharges into a liner or in casing. A packer separates the intake of the pump from the discharge into the casings. Although there are some patents and technical literature dealing with deploying EPS'S on coiled tubing, only a few installations have been done to date, and to date they have only been installed inside large casings, where the oil can flow around the outside of the motor and the pump intake is on the housing diameter.

Further when a well operator wishes to take measurements of the well, the well may be killed and electric submersible pump removed so that sensing equipment can be lowered down the well to take readings; once the readings have been taken, the sensors are removed and the electric submersible pump. Alternatively, a Y-tool system may be used, where the production tubing includes a bifurcation, with the ESP placed in the offset branch of the tubing so that logging tools can be lowered past the ESP, as is well known in the art.

OBJECTS OF THE INVENTION

It is an objective of this invention to be able to provide an electric submersible pump that can conveniently be lowered through a well.

Another objective is to be able to provide an ESP that may be used without killing the well it is to be deployed in. Another objective is to allow convenient sensing to be carried out in a well with an electric submersible pump in it.

SUMMARY OF THE INVENTION

According to the invention there is provided an assembly for downhole applications, comprising an electric motor, a pump, driven by the electric motor, the pump having a pump inlet, and the assembly having an assembly opening, the assembly being suspended from and lowered through the well on a deployment tube, the electric motor and the pump both being hollow such that a bore passes from the tube through the motor and the pump to the assembly opening at the bottom of the assembly such that a device suspended on a wireline or coiled tube may be lowered through the deployment tube and pass through the electric motor and pump to the part of the well below the pump inlet.

Well bores may be inclined away from the vertical, and indeed can even have horizontal regions. The words 'above' 'beneath', 'higher' 'lower' and similar terms are intended to indicate position along the well bore from the surface, even where the well bore may in fact be horizontal, so if a first element is 'beneath' a second element, where the well is horizontal this could mean simply that the first element is further along the well bore from the surface than the second element.

BRIEF DESCRIPTION OF THE DRAWINGS

The following FIGS. will be used to describe embodiments of the invention which are given as examples and not intended to be limiting.

DESCRIPTION OF THE PREFERRED EMBODIMENTS

Figure 1:
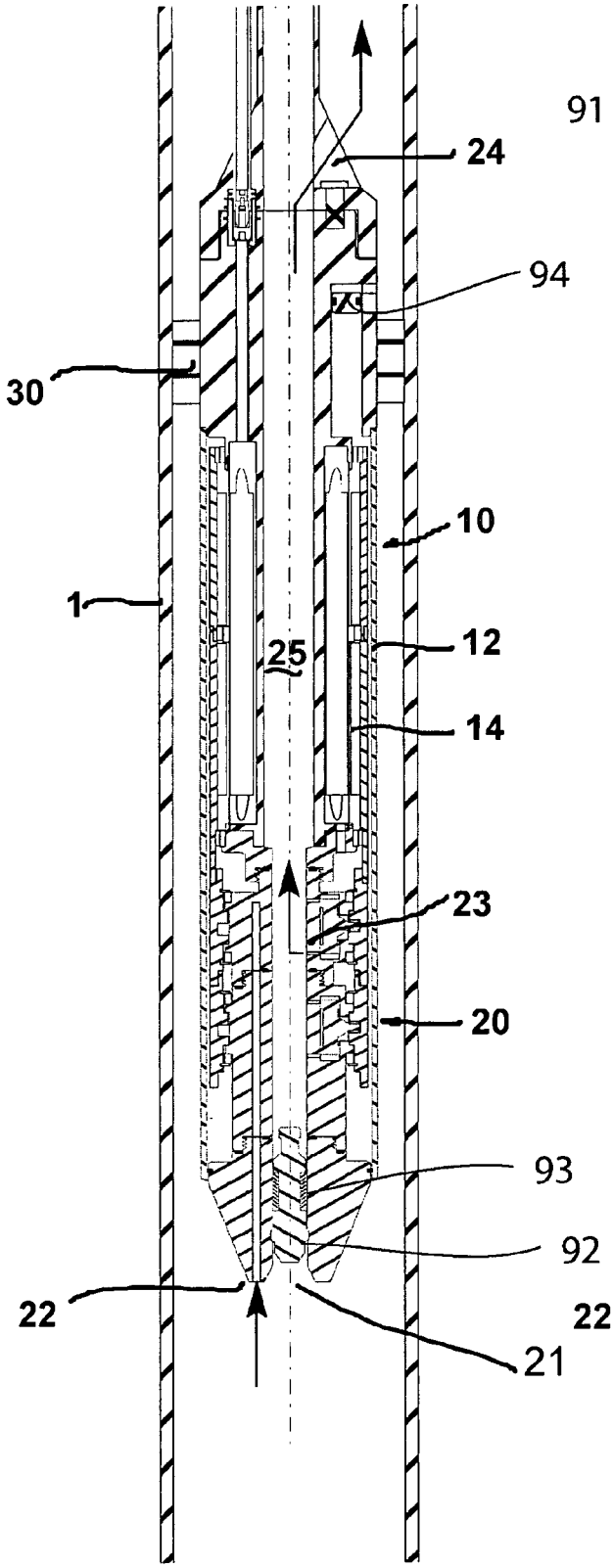
FIG. 1 is a side view of an embodiment of the electric submersible pump and motor assembly deployed in a well
Figure 2:
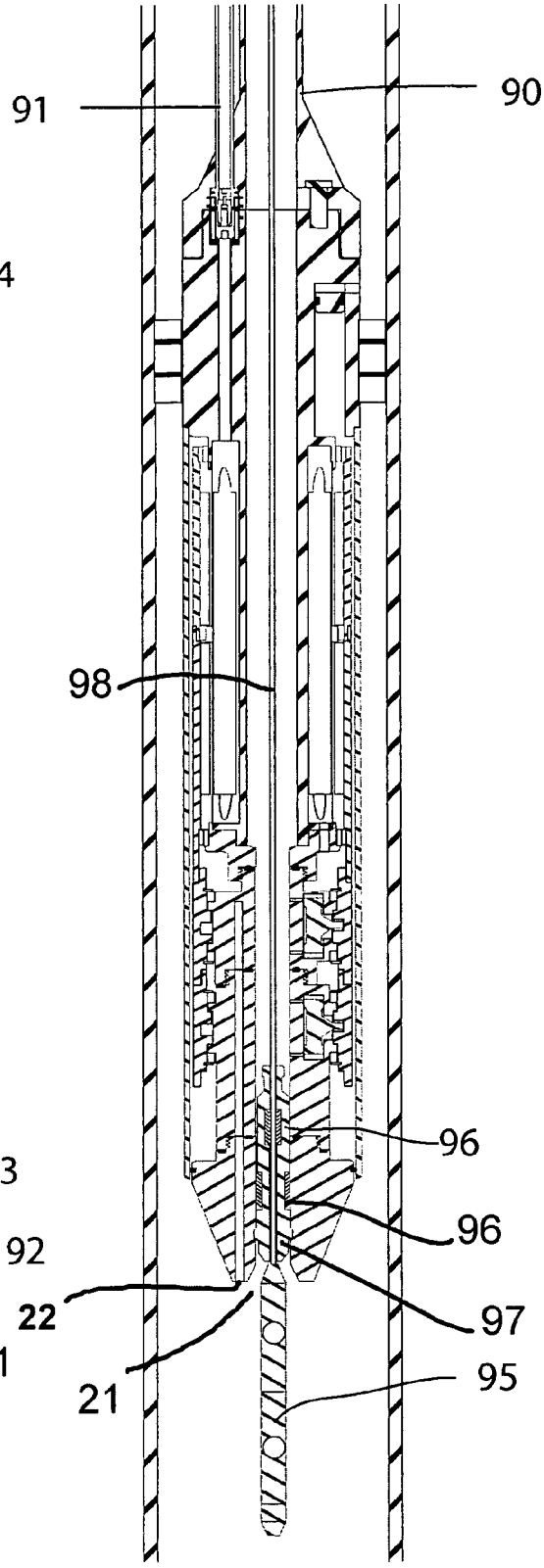
FIG. 2 is similar side view as FIG. 1 with a logging tool passing through the center of the motor and pump

Referring to FIGS. 1 and 2, there is shown an electric submersible pump and motor assembly comprising a motor 10 and pump 20 within a common housing 15 lowered into a well 1 on tubing 90, with the power cable 91 strapped to the outside of the tubing 90. The pump may be sealed against the well casing 1 with a packer 30. The motor comprises an annular rotor 12 positioned circumferentially outside an annular stator 14. A large bore 25 exists passing through both the motor and pump. A moveable compensation means 94 seals the motor oil chamber so that rotor oil pressure automatically adjusts to match changes in the assembly's environmental pressure as the electric submersible pump is operated. At the lower end of the pump is a dockable plug 92 having seals 93 which blocks the bore 25 at the assembly opening 21.

The motor 10 drives the pump 20 such that well fluid is drawn into the pump inlet 22, out of the pump into the assembly's bore 25 through a bore port 23, up the bore 25, and through the pump outlet 24. Alternatively, fluid may be pumped to the surface through the tube 90, in which case the packer 30 may be dispensed with. The specific operation of the pump is described below.

This bore 25 is dimensioned to enable logging tools or other devices 95 to be lowered down the tube from the surface, and pass through the center of the motor and pump and out through the assembly opening 21. For a tool to pass through the assembly opening, the dockable plug 92 must be removed. This may be accomplished for example by retrieving the plug with a wireline fishing tool; the dockable plug 25 may have a latching means so as to be relatively easy to remove in a downward direction but immovable in an upward direction. The tool 95 may be lowered down the coiled tube on a wireline 98, or if necessary on narrower coiled tubing, depending on the tool's purpose. The tool 95 is lowered with a plug 97 which as well as external seal 93 also has an internal dynamic seal 96 through which the wireline or coiled tubing extends, so that after the plug has docked to seal the bore of the assembly the logging tool or other device may continue to be lowered past the electric submersible pump. This arrangement enables the pump to run while the lower zone is being logged, or serviced by coiled tubing. Other benefits of this assembly are no rotating seal is required, no thrust bearing is required, and the oil compensation chamber requires only non-rotating seals.

Figure 3:
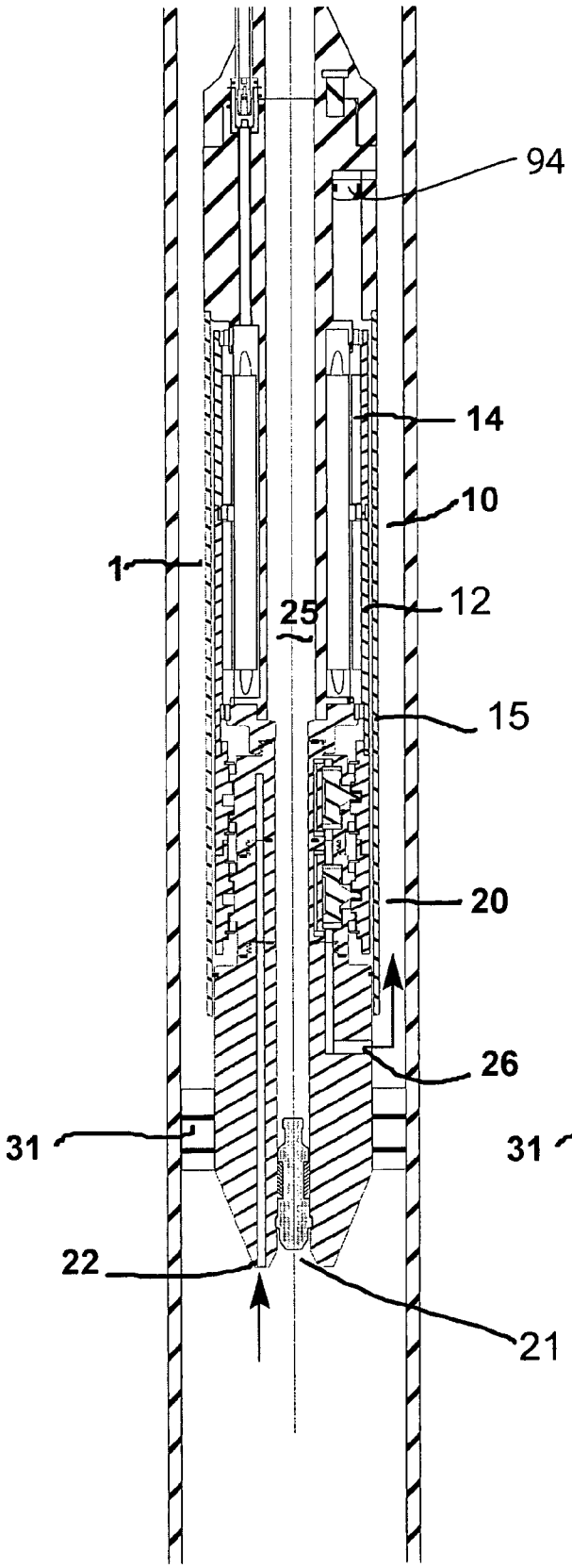
FIG. 3 is a side view of a further embodiment of the electric submersible pump and motor assembly
Figure 4:
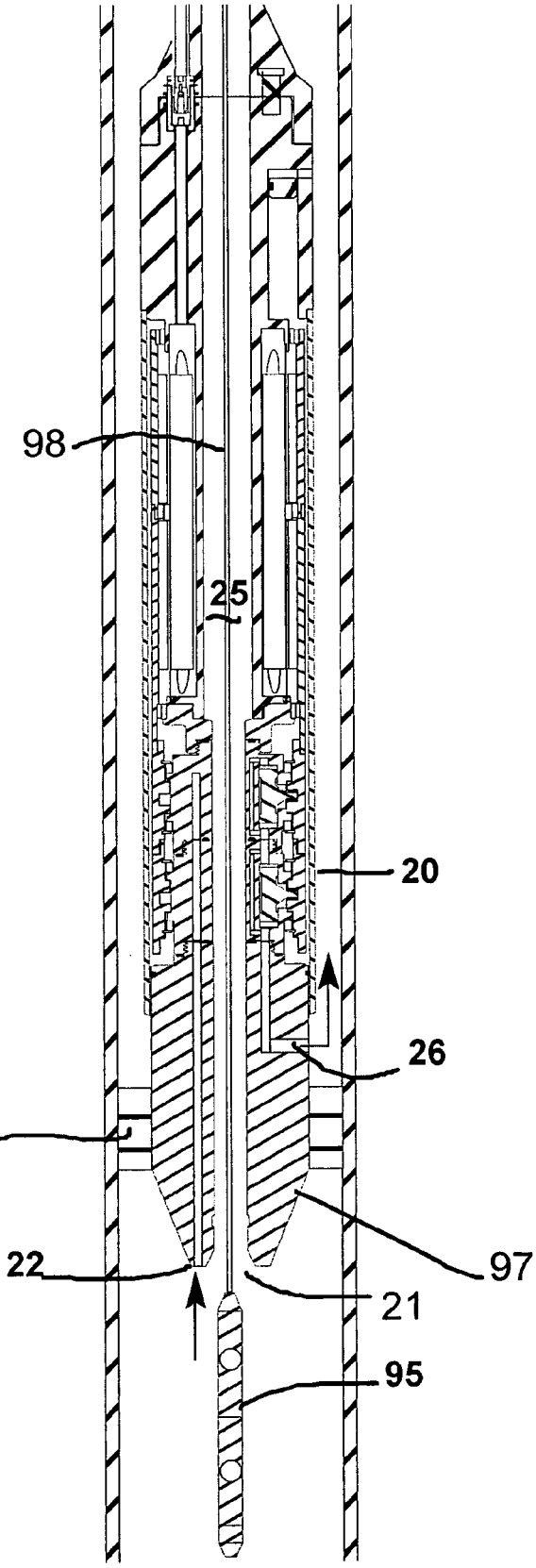
FIG. 4 is similar side view as FIG. 3 with a logging tool passing through the center of the motor and pump.

Referring to FIGS. 3 and 4, a packer 31 may be located close to the lower end of the pump as shown, and the pump arranged so that well fluid passes through the inlet port 22 and out through a lower outlet port 26 into the well bore above the packer, rather than through the bore of the electric submersible pump as was the case for the first embodiment. This arrangement completely isolates the bore of the electric submersible pump from the pumped fluid, and it is possible to pump fluid through the pump 20 and up the annulus 25 without sealing the bore through the assembly with a plug as described in the previous embodiment, as shown, although a plug with a dynamic seal may be included if desired. The specific operation of the pump is described below.

The motor and pump shown in FIGS. 1 and 2 will now be explained briefly with reference to FIG. 5. The motor 10 is ideally a brushless DC type, and comprises a stator 51 having coiled windings, arranged with an annular rotor 52, including magnetic portions. The rotor 52 is connected to a rotating sleeve 53 of the pump. This rotating sleeve includes internal elliptical cammed surfaces 54 which run around the inner surface of the rotating sleeve, the cammed surfaces 54 all lying parallel to a plane inclined from the perpendicular of the pump's axis. The pump includes a plurality of cylinders 56, all movably housed in chambers 57. The cylinders all include pins 55 which engage in the elliptical cammed surfaces 54. The chambers are radially fixed and do not rotate.

As the pump sleeve 53 rotates, the portion of the elliptical cammed surfaces 54 that the cylinder pins 55 engage in rises and falls, causing each cylinder 56 to rise and fall within its chamber 57.

Pump inlet 22 leads to an inlet passage 26 which in turn communicates with the top and bottom of each chamber 57 via non-return valves such that fluid may flow from the inlet passage 26 to the chambers but not vice versa. Outlet ports 58 also communicate with the top and bottom of each chamber via non-return valves such that fluid may flow from the chambers through the outlet ports to the assembly's bore 25 but not vice versa.

As each cylinder rises or falls, one end of each chamber is under compression while the other is under expansion. Fluid is therefore drawn from the inlet passage into the expended end of the chamber, while fluid is forced through an outlet port 58 into the bore from the compressed end of the chamber. Each revolution of the rotating sleeve 53 causes the cylinder to rise and fall once, so each end of the chamber undergoes compression and expansion during a full cycle.

Figure 5:
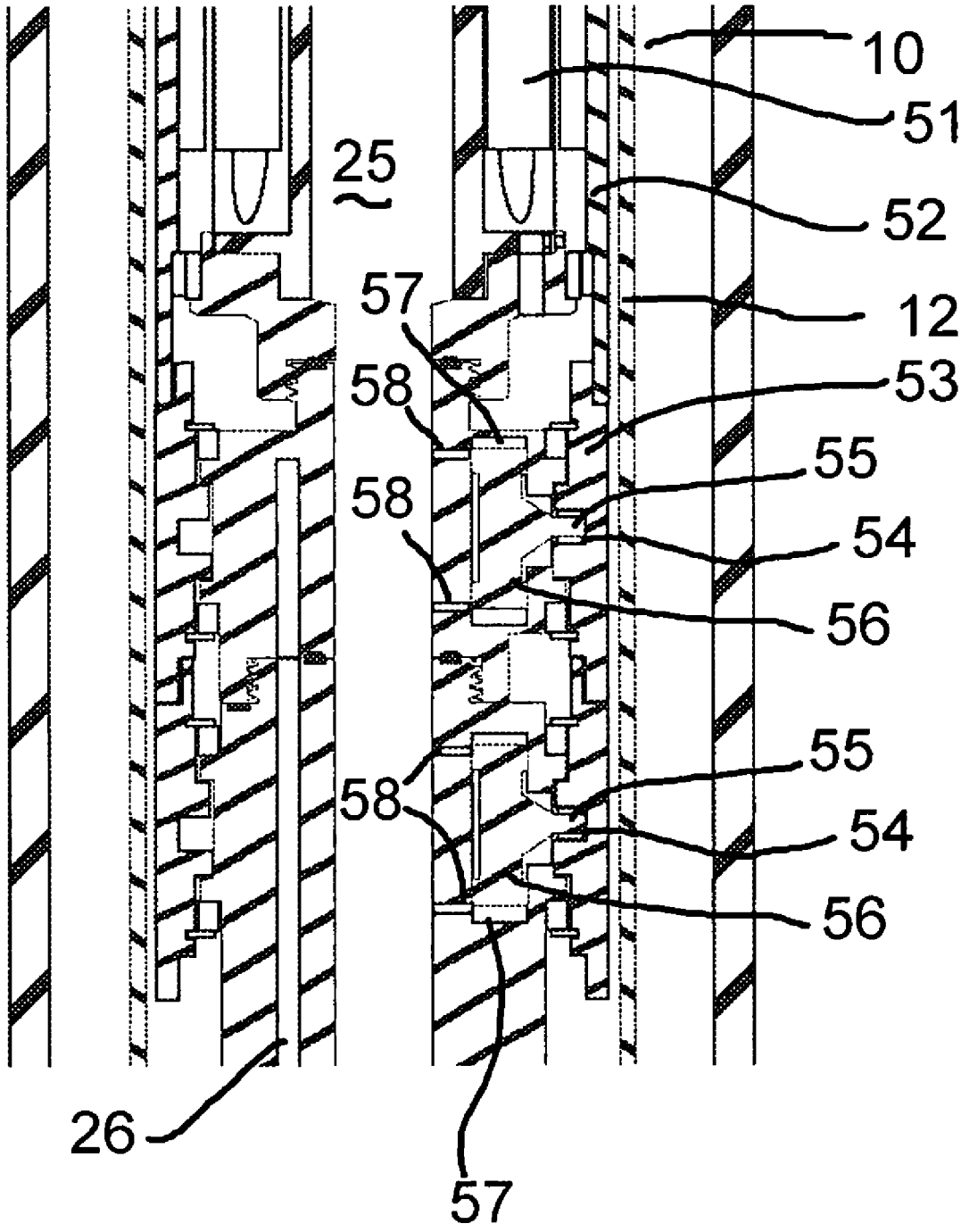
FIG. 5 is a side view of the pump from the first embodiment
Figure 6:
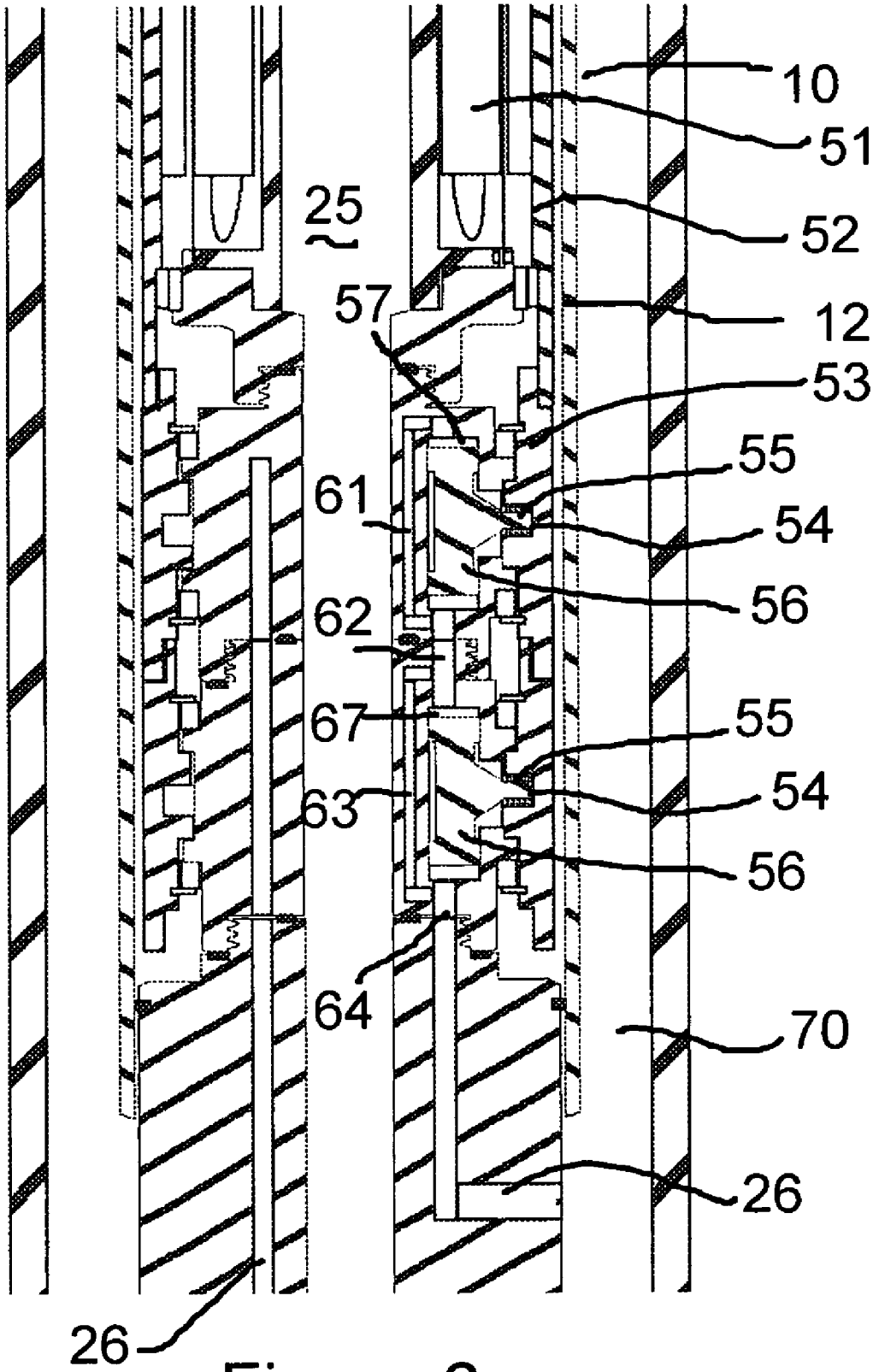
FIG. 6 is a side view of the pump from the second embodiment

Referring now to FIG. 6, the motor and pump shown in FIGS. 3 and 4 is similar to that shown in FIG. 5, the cylinders 56 having pins 54 that engage with eccentric cammed surfaces 54 in the rotating sleeve 53, the rotating sleeve being driven by the annular rotating stator 52 of motor 10. Again, pump inlet 22 leads to an inlet passage 26 which in turn communicates with the top and bottom of each chamber 57 via non-return valves such that fluid may flow from the inlet passage 26 to the chambers but not vice versa.

However, the top and bottom ends of chamber 57 are connected to a passage 61, similarly the top and bottom ends of chamber 67 are connected to a passage 63. Passage 61 and passage 63 are linked by a passage 62, and passage 63 also leads to an outlet passage 64 which terminates at lower outlet port 26 opening into the annulus 70 between the assembly and the production tubing. Again, the top and bottom ends of the chambers 57 and 67 are linked to the passages 61, 62, 63 and 64 by non-return valves, such that while the rotating sleeve causes the cylinders 56 to rise and fall, fluid is drawn from the inlet passage 26 when the end of a chamber is under expansion, while when the end of a chamber is under compression fluid is forced into the passages 61, 62, 63, 64 and ultimately vented through port 26 into annuls 70.

It will be realized that different arrangements of cylinders an passages could be used to effect the invention, or even a different type of pump such as an impeller pump could be adapted.

Alternative embodiments using the principles disclosed will suggest themselves to those skilled in the art upon studying the foregoing description and the drawings. It is intended that such alternatives are included within the scope of the invention, which is limited only by the claims.

What I claim is:

1. An assembly for downhole applications, the assembly comprising an electric motor, a pump driven by the electric motor and having a lower pump inlet and an upper pump outlet, a nonrotating deployment tube from which the assembly is suspended from and by means of which the assembly can be lowered through the well, a nonrotating hollow shaft on the tube forming a bore extending from the tube through the motor and through the pump to an assembly opening at the bottom of the assembly such that a device suspended on a wireline or coiled tube lowered through the deployment tube and pass along the bore through the electric motor and pump to a part of the well below the pump inlet, and means outside the bore linking the motor to the pump for driving the pump from the motor.

2. The assembly according to claim 1, further comprising a power cable leading from the surface to supply power to the electric motor.

3. The assembly according to claim 1 wherein the pump outlet opens into the deployment tube.

4. The assembly according to claim 1 wherein the pump outlet opens into a production tube.

5. The assembly according to claim 1, further comprising a seal that engages with a lower region of the assembly to seal the bore running through the assembly.

6. The assembly according to claim 1 wherein a device on a wireline is lowered through the assembly, the device and wireline including a seal above the device that engages with the lower region of the assembly to seal the bore and includes a dynamic seal to allow the wireline to continue to pass through the bore running through the assembly.

7. The assembly according to claim 1 wherein the pump outlet is situated beneath the electric motor.

8. The assembly according to claim 1 wherein the pump outlet is situated above the electric motor.

* * * * *